United States Patent [19]

Cerny et al.

[11] 4,398,648

[45] Aug. 16, 1983

[54] FLANGE STRUCTURE FOR PLASTIC CONTAINER

[75] Inventors: Daryl D. Cerny, Greenville, Ohio; Virgil C. Reynolds, Jr., Yorktown, Ind.

[73] Assignee: Ball Corporation, Muncie, Ind.

[21] Appl. No.: 289,355

[22] Filed: Aug. 3, 1981

[51] Int. Cl.[3] ..... B65D 6/38

[52] U.S. Cl. ..... 220/67; 220/74

[58] Field of Search ..... 220/66, 67, 74, 309; 229/5.6

[56] References Cited

U.S. PATENT DOCUMENTS

| | | | |
|---|---|---|---|
| 2,196,206 | 4/1940 | Foss | 220/67 |
| 3,452,897 | 7/1969 | Anthony | 220/67 |
| 3,685,685 | 8/1972 | Phillips | 220/67 |
| 3,923,190 | 12/1975 | Roth | 220/67 |
| 4,008,347 | 2/1977 | Amberg et al. | 428/35 |

*Primary Examiner*—Steven M. Pollard
*Assistant Examiner*—David Voorhees
*Attorney, Agent, or Firm*—Gilbert E. Alberding

[57] ABSTRACT

A container having a novel flange configuration is disclosed that may be readily rolled with a closure to form an interlocking double seam to provide a leakproof container. The flange configuration may be readily interlocked due to its flexibility and resiliency with a closure without the flange being distorted, fractured or cracked. The container includes a peripheral flange connected to and surrounding the opening of the container, the flange having a channel adjacent the sidewall and a complementary bead associated therewith. In one embodiment, the container is made of a thermoplastic material comprising a plurality of superimposed layers, one of which is yieldable, so that when the flange is interfolded the yieldable material is forced outwardly to fill any that exist voids between the flange and closure to form a complete and flexible seal.

2 Claims, 7 Drawing Figures

FLANGE STRUCTURE FOR PLASTIC CONTAINER

BACKGROUND OF THE INVENTION

This invention relates to plastic containers or similar receptacles and particularly those in which such containers are made of orientable, multilayered thermoplastic materials forms by solid state pressure forming processes. Containers of this character made in accordance with the subject invention are composed of a cylindrical sidewall with a bottom endwall integral therewith and an opening with a flanged peripheral portion surrounding the opening thereof, the flanged portion being especially contoured to receive a metal or thermoplastic closure.

Solid state pressure forming is a special process used to form oriented plastic containers, especially multilayered thermoplastic containers. In general, a container is produced by forming a circular preform which in turn is forged from a blank plastic chip, the preform thereafter being thermoformed into the finished container. During the forging operation, the rim of the container is held by a gripping fixture that acts to clamp the preform while the center portion of the preform is maintained at a predetermined temperature for thermoforming step. It will be appreciated that there will be a high degree of orientation built into the finished container through such forging of the preform and thermoforming process. As a result containers so made have improved strength and stress crack resistance.

Generally, a conventional closure is sealed to a receptacle or container by means of a seaming operation. However, a number of problems may arise in effectively sealing such containers with a closure. For example, when a single seam is used in the absence of special chemical sealants the single seam is not sufficient in that it does not effectively seal to render the container leakproof. When double seaming iis used to seal metal closures to thermoplastic containers, it is generally found that such sealed containers likewise present some leakage problem due to a number of reasons, especially in the tendency of a metal closure to cut through the plastic flange during the sealing operation which eventually results in the release of the contents of the container. Furthermore, during shipment when thermoplastic containers are accidentally dropped they are often deformed to the extent that their products seep or ooze out. Such leakage results in loss of product as well as damage to the appearance of the container and label.

Various attempts have been made to avoid these problems. Admittedly, it has been found relatively difficult to provide satisfactory means by which conventional closures can be successfully attached to containers of the thermoplastic type. Certainly, any means of attachment employed for uniting the container body with the closure must be one which will positively provide a leakproof container. In addition, the closure should be so attached as to somewhat stiffen the entire container body to provide as rigid a structure as possible and be so attached as to avoid disconnection during the normal use of the container.

In the U.S. Pat. No. 2,196,206 to Foss a container is described having a flange with a circumferential line of weakening disposed at the base of the flange and when this flange is double seamed to a closure it forms a fractural seam so that the container remains tamperproof in that the container cannot be opened and resealed to assume an appearance identical to the original container. It will be appreciated that the flange configuration herein disclosed is nonfractural and is reversely bendable. In the prior art, attempts have been made to join a closure with a plastic flange configuration in forming a sealed container, especially a plastic container having low gas permeability. In U.S. Pat. No. 3,923,190 to Roth one approach of interfolding a thermoplastic flange portion with a closure is the use of a preform or billet having its peripheral area devoid of any plastic material of low permeability. The subject invention does not require such a drastic approach. Since the patentee does not use a multilayered structure wherein the layers are parallel to the walls of the container as would be produced by conventional coextrusion techniques but a layered structure wherein the layers are at right angle to the walls the patentee's approach would apparently be impractical in the environment of this invention. As disclosed and claimed herein, a preform formed from a multilayered structure produced by coextruding a plurality of polymeric material, even with a low gas permeable layer, can be readily utilized and interfolded.

SUMMARY OF THE INVENTION

The subject invention was developed as an improvement in containers with flanged portions used to interfold with closures, said flanged portions having a configuration that effectively provides a leakproof container. In particular, the subject invention relates to a thermoplastic container having a sidewall and an integral bottom wall at one end, an opening at the other end, and a peripheral flange integral with said sidewall and surrounding said opening, said flange being adapted to interfold with the periphery of a closure to form an interlocking seam therewith to close the opening of the container, said flange having on one surface thereof a first channel situated circumferentially and adjacent said sidewall, said channel having a radius of curvature substantially equal to about the thickness of the periphery of said closure.

The present invention was developed to provide an improved foldable or seamable configuration for conventional metal or plastic closure members, wherein the configuration is so designed that excellent strength is maintained whereby a leakproof seal is established without need for special external chemical sealants or sealers or the need for special equipment to apply the same.

Accordingly, a primary object of the subject invention therefore, is to provide a simple and practical means by which closures may be readily attached to a thermoplastic container, to meet all of the requirements above-mentioned.

Another object of the subject invention is to provide means that are useful in a folding or seaming operation in forming a durable seamed closure structure without compromise of the container's integrity.

A further object of the invention is to provide means for interfolding the ends of the container, that said closure may be speedily and securely attached to the container body with a minimum of labor and without the performance of extraordinary assembly operations or equipment.

Numerous other objects and advantages of the invention will be apparent as it is better understood from the following description, which, taken in connection with the accompanying drawings, discloses preferred embodiments thereof.

The subject invention provides an effective thermoplastic container that may be readily interfolded or double seamed, and even though the closure and plastic container are deformed the plastic flange configuration attached to the container readily responds to the closure thereby not allowing any cracks, crevices or leakage channels to form. Moreover, the particular flange configuration is so designed as to be readily folded in sealing relationship with a wide variety of closures, especially those closures having frusto-conical annular wall members as described hereinafter and, therefore, eliminate the need for any sealing composition or sealer material to perfect an air-tight seal when double seamed to conventional closures.

An important aspect of this invention is that no modification of the state of the art double seaming equipment is needed to form and to provide the new plastic container herein disclosed. One type of machine which can be used to double seam the containers herein is disclosed and described in U.S. Pat. No. 2,028,202 to Gauthier.

DESCRIPTION OF THE DRAWINGS

FIG. 2(*a*) is a cross-sectional elevational view of the same flange portion of FIG. 2 that has been subjected to double seaming;

FIG. 3(*a*) is the cross-sectional view of the same flange portion of FIG. 3 that has been subjected to double seaming;

FIG. 4(*a*) is the cross-sectional view of the same flange portion of FIG. 4 that has been subjected to double seaming.

PREFERRED EMBODIMENTS

Figure 1:
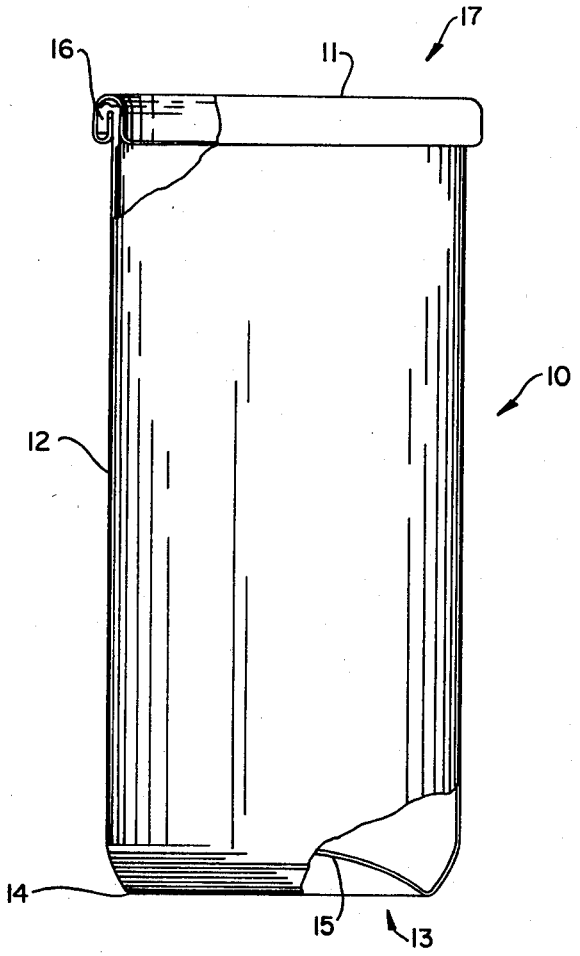
FIG. 1 is an elevational view of a closure and container of this invention.
Figure 2:
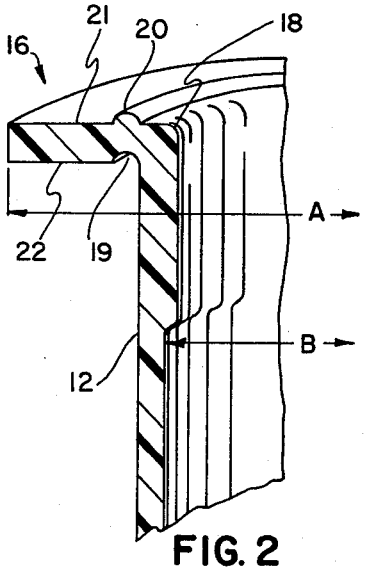
FIG. 2 is a cross-sectional elevational view of a flange portion of a plastic container in accordance with this invention.
Figure 2A:
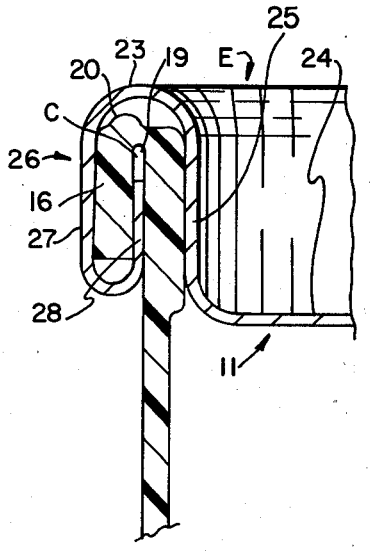

Referring to FIG. 1 there is illustrated a thermoplastic container 10 having a sidewall 12 integrally connected to a bottom endwall 13 by means of a curvilinear surface 14, the bottom endwall being provided with a central panel 15 which may be dished or recessed inwardly. Prior to being interfolded, the container 10 is provided with an outwardly extending radial peripheral flange 16 that surrounds the upper portion of the open end 17. As shown in FIG. 2 of an enlarged sectional view of the flange area of the container an outwardly peripheral flange 16 is depicted which merges into the sidewall 12 by a transition zone 18 of arcuate profile. By construction during forging such as by solid state forming, the flange 16 is so made that its exterior diameter or dimension A is slightly greater than the diameter or dimension B of the container 10 and provides substantially flat upper and under surfaces 21 and 22, respectively. Flange 16 is further provided with a complementary bead 20 located on the upper surface 21 of flange 16 as well as an annular channel 19 located on the under surface 22 of flange 16 and immediately adjacent to said sidewall 12. Upon being double seamed with a conventional closure 11 the flange configuration shown in FIG. 2 takes on the appearance of FIG. 2(*a*) in cross section. In double seaming the flange 16 is bent outwardly and downwardly to form at channel 19 a curved corner C and the flange is correspondingly sealed to a closure 11 with the outer edge E of the closure 11 extending outwardly, downwardly and upwardly around the flange in an interfolding relationship in accordance with normal double seaming. The closure 11 is provided with a flat or disk-shaped center portion 24 having an upstanding outer wall 25 defined therearound, a bight 23 connected to said wall 25, and a radially extending securing element 26 comprising a flat annular portion 27 and a hooked part 28.

Figure 3:
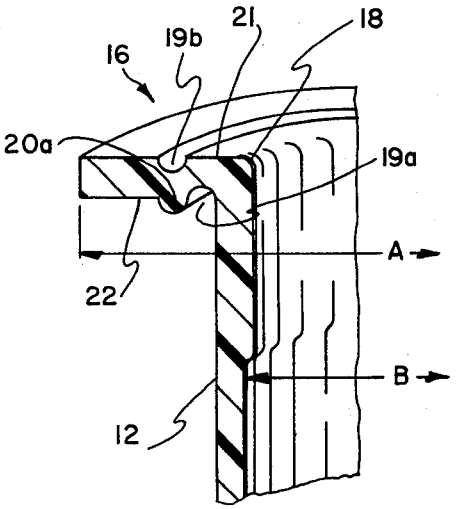
FIG. 3 is another cross-sectional elevational view of a flange portion of a plastic container in accordance with this invention.
Figure 3A:
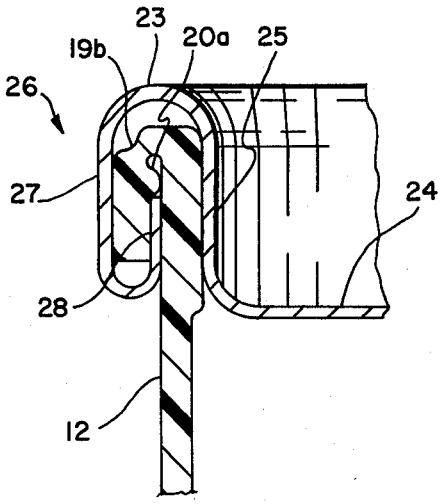

Another embodiment for the flange configuration is shown in FIG. 3 wherein the sidewall 12 is provided with an outwardly extending radial peripheral flange 16 surrounding the open end 17, the flange being provided with an annular channel 19*a* situated immediately adjacent sidewall 12 and a complementary bead 20*a* located on the under surface 22 of the flange adjacent the channel 19*a*. FIG. 3 further shows a second annular channel 19*b* located in the upper surface 21 of the flange, said channel 19*b* overriding the bead 20*a*. Again, upon being double seamed the flange 16 of FIG. 3 is interfolded and takes on the appearance of FIG. 3(*a*) in cross section.

Figure 4:
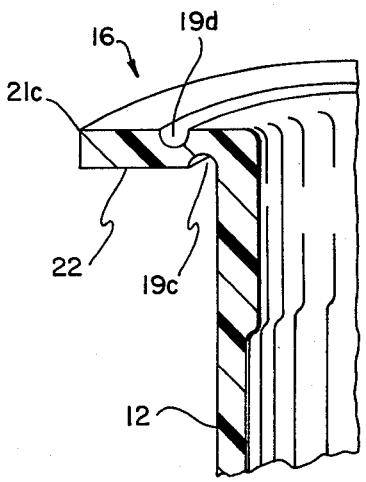
FIG. 4 is still another cross-sectional view of a plastic container in accordance with this invention.
Figure 4A:
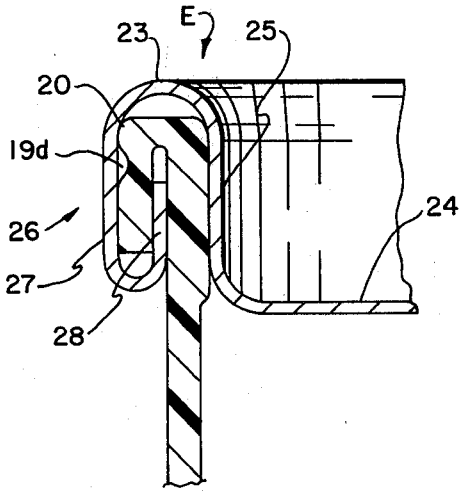

Another preferred embodiment for the flange configuration is shown in FIG. 4 in which a first annular channel 19*c* is located adjacent the sidewall 12 and a second annular channel 19*d* is located on the upper surface 21*c*. This particular flange when double seamed would take on the appearance of FIG. 4(*a*) in cross section.

The annular channel 19 is so situated that it is immediately adjacent the sidewall 12 and provides an opening having a predetermined dimension, preferably greater than a mere narrow line of weakness and, generally, is one of greatly reduced thickness of at least about one-half the thickness of the flange thickness. Preferably, the channel should have a width of the order of about 0.020 inch and a thickness thereat from about 0.010 inch to about 0.015 inch, much less the thickness of the sidewall which generally varies from about 0.015 inch to about 0.050 inch. The channel allows the flange structure to be readily foldable n a predictable and consistent manner, viz, along a path immediately adjacent the sidewall, during the double seaming operation to thereby form a well joined and sealed container. It has been found that when a flange having the features of this invention as herein described that the resulting containers have better seals. Seemingly, this is because the defined channel allows the plastic material to release the stress built up during the sealing of a plastic container with a closure that results. This stress is somehow imparted during the seaming operation by the so called wave generation effect. Thus, an important aspect of the subject flange configuration is that it greatly reduces the tendency of the thermoplastic material to undergo wave generation, that is the accumulation of plastic material during seaming. It has been observed that the wave generation is apparently at its maximum upon the final moment of seaming, the net result of wave generation being that it produces a closure that does not seal properly. This is brought about by the mechanical working of the thermoplastic material itself during the seaming step since the flange that is folded downwardly is compressed on the lower side to a marked degree resulting in resistance to the bending force.

Multilayered thermoplastic structures have recently been proposed for making containers. In a preferred embodiment of this invention such layered structures may be readily formed with at least one yieldable layer. In general, this yieldable layer is often a polymeric or resinous material that has a low coefficient of compression as compared to the other polymeric layers superimposed in the thermoplastic material. Preferably, the yieldable layer may be an adhesive or glue layer. Such yieldable glue layers are used to adhesively bond one layer of thermoplastic material to an adjacent layer of polymeric or resinous material. Yieldable layers herein contemplated include copolymers of ethylene, styrene-butadiene latex compounds, ethylene vinyl acetate latex compounds, and the like as well as copolymers of ethylene with monocarboxylic acid and other copolymers including ethylene and vinyl acetate, copolymers of ethylene and ethyl acrylate, copolymers or ethylene, and isobutylene acrylate and chlorinated polymers of ethylene, and the like. By blending or mixing two different types of polymeric materials a satisfactory thermoplastic layer composition may be provided for multilayered structures of the present invention.

The multilayered thermoplastic structures may have a layer that reduces gas permeability. This is important in containers of packaged foodstuffs wherein permeable gases like oxygen may pass through the sidewalls into the container to cause an undesirable discoloration as well as a depreciation in the taste and qualities of the foodstuffs. Layers that exhibit high gas barrier properties include nylon, saran or polyvinylidene chloride, and acrylonitrile polymers.

It will be appreciated from the disclosure that the subject invention makes it possible to interfold in a straightforward fashion a container flange with a metal closure whereby the closure is joined and sealed to the container body. As described the body and flange are rolled together to form an interlocking double seam. During the double seaming operation, the flange is squeezed or pressed together under considerable pressure to provide a hermetic seam. The novel structural configuration of the subject invention allows the flange to be properly interlocked due to its flexibility and resiliency with a given closure without the flange portion being distorted, fractured or cracked during the double seaming operation.

The complementary bead is found advantageous in allowing the seamed container to be effectively sealed to the closure by providing this skirt-like member to extend in abutting relationship upon the interfolded closure. In addition, in certain applications by having a thicken bead portion on the flange this lends itself to the use of special techniques for uniting metal to plastic, especially bond sealing by ultrasonic welding and the like. Although the subject invention does not require sealing compositions to be utilized in conjunction therewith, sealing compounds are not necessarily ruled out where, in some special applications, very high standards of hermetic sealing are required.

While several specific embodiments of this invention have been shown and described in detail to illustrate the application of the inventive principles, it will be understood that the invention may be embodied otherwise without departing from such principles.

What is claimed is:

1. A container comprising a sidewall and an integral bottom wall with one end of said container being open, a peripheral flange integral with said sidewall and surrounding said open end, said flange being adapted to interfold with the periphery of a closure to form an interlocking seam therewith to close the open end of the container, said flange having on one surface thereof a first channel situated circumferentially and adjacent said sidewall, said channel having a radius of curvature substantially equal to about the thickness of the periphery of said closure, and said flange having a complementary bead overriding said channel on the other side of said flange.

2. A container comprising a sidewall and an integral bottom wall with one end of said container being open, a peripheral flange integral with said sidewall and surrounding said open end, said flange being adapted to interfold with the periphery of a closure to form an interlocking seam therewith to close the open end of the container, said flange having on one surface thereof a first channel situated circumferentially and adjacent said sidewall, said channel having a radius of curvature substantially equal to about the thickness of the periphery of said closure, said flange being provided with a second channel situated on the side opposite the side having the first channel, and said flange having a complementary bead located on the underside of said flange whereby said second channel overrides said bead.

* * * * *